US005711384A

United States Patent [19]

Jenne

[11] Patent Number: 5,711,384

[45] Date of Patent: Jan. 27, 1998

[54] ANCHORING APPARATUS FOR THE BORING WAGON OF A MOBILE EARTH BORING MECHANISM

[75] Inventor: Dietmar Jenne, Strengelbach, Switzerland

[73] Assignee: Terra AG fuer Tiefbautechnik, Strengelbach, Switzerland

[21] Appl. No.: 604,419

[22] Filed: Feb. 21, 1996

[30] Foreign Application Priority Data

Feb. 23, 1995 [DE] Germany ..... 195 06 337.6

[51] Int. Cl.[6] ..... E21B 19/08

[52] U.S. Cl. ..... 175/203; 175/323

[58] Field of Search ..... 175/73, 74, 75, 175/203, 325.1, 325.3, 323; 299/64, 33

[56] References Cited

U.S. PATENT DOCUMENTS

| | | | |
|---|---|---|---|
| 2,044,876 | 6/1936 | Curtis | 175/203 |
| 3,896,890 | 7/1975 | Gale | 175/19 |
| 3,982,688 | 9/1976 | Taylor | 299/64 |
| 4,436,455 | 3/1984 | Vance | 405/303 |
| 4,585,080 | 4/1986 | Beuder | 175/170 |
| 4,758,049 | 7/1988 | Weinigg et al. | 299/33 |
| 4,858,700 | 8/1989 | Shafer | 173/22 |
| 4,966,417 | 10/1990 | Zitz et al. | 299/33 |
| 5,039,068 | 8/1991 | Venturini et al. | 175/203 X |
| 5,303,783 | 4/1994 | Begnaud et al. | 175/203 X |

FOREIGN PATENT DOCUMENTS

| | | | |
|---|---|---|---|
| 2273120 | 8/1994 | United Kingdom | 175/203 |

*Primary Examiner*—Frank Tsay
*Attorney, Agent, or Firm*—McCormick, Paulding & Huber

[57] ABSTRACT

For bracing the wagon of a mobile earth boring mechanism, which wagon has a boring rod guide and feed ramp inclined to the surface of the earth when in its working position, at least one anchor is provided having an elongated shaft which is driven into the earth so as to extend generally parallel to the inclined direction of the ramp and which is connectable to the ramp by an associated connecting device. For better resisting loads applied to the anchor, the anchor shaft may have attached to it a helical worm. The anchor or anchors effectively brace the ramp of the boring machine against both tension and compressive forces with substantially no lateral loads being applied to the anchor; and the drive of the boring mechanism which is normally used for rotating and axially moving the boring rod of the mechanism may be used to emplace the anchor or anchors.

12 Claims, 2 Drawing Sheets

ANCHORING APPARATUS FOR THE BORING WAGON OF A MOBILE EARTH BORING MECHANISM

FIELD OF THE INVENTION

The invention relates to an anchoring apparatus for the boring wagon of a mobile earth boring machine having an undercarriage, a ramp arranged on the undercarriage and inclinable relative to the surface of the earth for holding and guiding a boring rod, and a drive unit for rotating and axially moving the boring rod.

BACKGROUND OF THE INVENTION

In the use of controllable boring equipment for the making of controlled essentially horizontal bores, a boring wagon is usually placed on the surface of the earth. With this being so, the beginning of the bore necessarily runs at an inclination to the earth surface, and in fact at the angle at which the boring ramp is inclined to the earth surface. This angle as a rule lies between 15° to 30°. After the boring head has reached the desired running depth, the boring direction is usually changed to a horizontal run by control of the boring head.

Since the bore lengths of controlled bores can be up to three hundred meters long, it is necessary for making the pilot bore to work with relatively high forces for advancing the bore forwardly. Modern controllable bore equipments work with boring forces of 50 to 100 kN. Since the dead weight of a boring wagon amounts to about 2 metric tons, it is necessary to the introduction of the bore advancing forces that the boring wagon be reliably anchored.

Usual anchoring systems work with anchoring stakes or with anchoring plates which are hammered into the earth perpendicular to the earth surface or perpendicular to the axis of the boring rod in the boring wagon. U.S. Pat. No. 5,341,887, for example, shows an approach using anchoring stakes.

Further, an anchoring system is known wherein rotatable earth anchors, which in themselves have been known for decades, are screwed into the earth perpendicularly to the earth surface. By means of these rotatable earth anchors, a large bottom plate is pressed against the earth's surface. Then, the forward end of the boring ramp of the boring wagon is fixed to this bottom plate. The earth anchors are screwed into the earth by the boring wagon itself, while the boring ramp is oriented vertically. This requires a construction of the boring wagon which is extremely consuming of materials and care and which is correspondingly expensive.

The disadvantage of all previous anchoring systems resides in that the real anchoring takes place at a right angle to the earth's surface or at a right angle to the bore axis at the beginning of the bore opening. Therefore, to absorb the actual bore advancing forces, the holding power of these anchoring systems has to be very large. In the case of an anchoring at a right angle to the bore axis, the theoretical holding force for entirely absorbing the bore advancing force would be infinitely large. In practice this means that these anchoring systems, as a rule, are not strong enough to take up the actual boring forces. In the making of the pilot bore, the boring wagon loosens and is pushed rearwardly. In doing this the boring wagon is usually also displaced laterally so that the boring rod at the location of its entrance into the earth is additionally laterally loaded.

After the completion of the controlled pilot bore, the boring head usually is unscrewed from the rod in the target excavation and replaced by a significantly larger widening head, to which is fastened a tube made of plastic or steel to be drawn into the bore. By reversibly pulling the boring rod with simultaneous rotation, the widening head is pulled through the earth from the target excavation to the boring wagon and, at the same time, the tube to be laid is drawn with it. The pulling forces required for this, and which the boring wagon must be prepared to deliver, are at least as high as the bore advancing forces. In the case of modern boring equipment, the pulling forces amount to as much as double the bore advancing forces. Therefore, the boring wagon also has to be well anchored for these pulling procedures of the boring wagon, since otherwise the theoretically possible pulling forces cannot at all be applied.

The invention has as its object the provision of an anchoring apparatus of the aforementioned type for a boring wagon, which with avoidance of the above-mentioned disadvantages and without a large construction expense, makes possible a reliable anchoring of the boring wagon in the case of both tension and compression loading.

This object is solved in accordance with the invention by providing at least one earth anchor, and a connecting device connecting the anchor to the boring wagon, with the anchor so positioned that the anchor is arranged at least nearly parallel to the inclined plane assumed by the ramp when the boring wagon is in its working position.

Therefore, since the earth anchor extends into the earth at least nearly parallel to the inclined plane of the ramp and in this position is connected with the boring wagon, the anchor during boring of the pilot hole and during withdrawal of the boring rod and the pulling into the bore of the pipe to be laid is loaded only in tension or compression. The anchor has to absorb essentially no transverse forces.

Preferably the anchor includes a shaft which near its one end carries a helical worm extending through at least 360°. The shaft can be provided at its end which is driven into the earth with a centering point. The diameter of the helical worm should be as large as possible in order to increase the resistance which the anchor can provide against axial compression or tension. In order to facilitate the screwing of the anchor into or out of the earth, it is desirable if the helical worm, which extends over more than 360°, proceeding from a large diameter middle section decreases in diameter in going toward both axial ends of the worm.

The anchor provided with the helical worm is driven into the earth by rotation and axial pushing. As to this it is practical if the shaft at its end opposite to the centering point has a coupling device for connecting the anchor with a rotation and pushing drive. If this is so, the anchor can, for example, be coupled with the boring rod drive of the boring wagon. In this case, the anchor can be driven into the earth from the ramp of the boring wagon in the position of the ramp which the ramp takes anyhow for the boring. No provisions are required for bringing the ramp into a special position for driving the anchor into the earth. Alternatively to this, the anchor can also be emplaced with the help of a separate drive apparatus.

The coupling device on the shaft can also serve for lengthening the shaft of the anchor by means of an extension rod, when the normal length of the anchor is not sufficient for a reliable anchoring.

In the preferred embodiment of the invention the connecting device between the boring wagon and the anchor has a support plate intended to rest on the earth surface which support plate on one hand is connectable with the forward end of the inclined ramp and on another hand carries a means for connecting it with the anchor or anchors. This solution makes possible the driving in of the anchor by means of the boring rod drive. Then subsequently the anchors are bracingly connected with the ramp of the boring wagon.

In connection with this, a reliable connection by simple means is achieved in that the connecting means includes a connecting plate which is connected rigidly with the support plate essentially perpendicular to an average inclined direction of the ramp in its drive position and which connecting plate has an opening through which the shaft of the anchor can be fed with play. Further, the shaft of the anchor, or a rod coaxially couplable to it, carries an external thread for threadably receiving clamping nuts between which the connecting plate is clampable. The support plate serves as a wide surfaced support for the ramp of the boring wagon when the widening head or the tube to be laid in the pilot bore is pulled through the pilot bore with the boring wagon being pulled toward the surface of the earth. At the same time, the wide surfaced support of the support plate prevents bending of the anchor which in this case is loaded in compression.

Since the direction of the force exerted on the boring wagon is not exactly predeterminable, and in order to better distribute the force, it is practical if at least two anchors are provided which are arranged on both sides of the boring ramp and which thereby form a broader basis for the bracing of the boring wagon. Moreover, the anchors can be so arranged that in the forward direction, they form open acute angles with the boring rod axis so as to be slightly spread. This prevents at least in the withdrawing procedure, when the anchors are compressively loaded, a lateral deflection of the boring wagon.

The following description explains the invention in connection with the accompanying drawings with respect to an exemplary embodiment.

DETAILED DESCRIPTION OF THE PREFERRED EMBODIMENT

Figure 1:
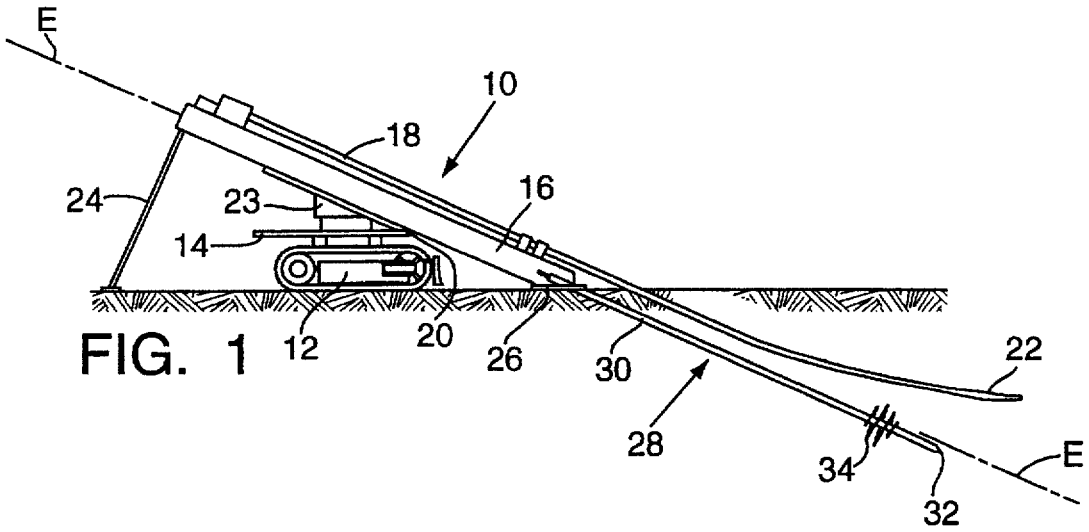
FIG. 1 A schematic side view of a boring wagon in working position.

FIG. 1 shows a boring wagon, indicated generally at 10, with a caterpillar undercarriage 12, on the platform 14 of which a ramp 16 is arranged for holding and guiding a boring rod 18. The ramp 16 is supported on the platform 14 for pivotal movement about an axis 20 so that it can be pivotally moved between a horizontal transport position and the work position illustrated in FIG. 1, in which work position it is inclined relative to the earth at an angle of about 25°. The platform 14 further carries a drive and control unit 23 for advancing and rotating the boring rod as well as for controlling the boring head 22 at the forward end of the boring rod 18. The ramp 16 is in a way known in itself at its rearward end supported from the earth's surface by a support 24. The boring wagon 10, as so far described, is known.

The forward end of the ramp 16, by means of which the ramp 16 in the working position illustrated in FIG. 1 is supported on the earth's surface, is connectable with a supporting plate 26. Held on this supporting plate 26 are two earth anchors indicated generally at 28. Each earth anchor consists of an elongated member in the form of a shaft 30 which at its forward end has a centering point 32 and in its forward end region carries a helical worm 34. The helical worm 34 includes several convolutions and has in its middle area a larger diameter with the diameter of the worm decreasing in going toward the axial ends of the worm 34.

Figure 5:
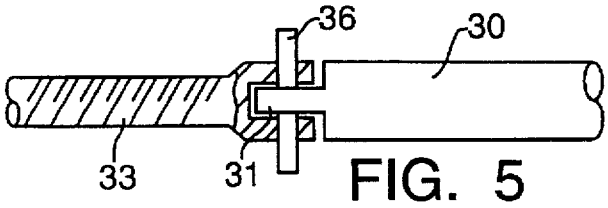

According to FIG. 5, the shaft of the earth anchor has at its rearward end a rectangular pin 31 which is received in a corresponding rectangular opening of a threaded rod 33 coaxial to the shaft 30. The connection is secured by means of a bolt 36, as illustrated in FIG. 5. This type of coupling serves as well for the connection of the shaft 30 with a threaded rod 33 as well as with an extension rod.

Two connecting plates 38 are so rigidly fastened to the support or bottom plate 26 that they form an acute angle with the support plate and are oriented essentially perpendicular to the inclined direction of the ramp 16. The connecting plates 38 are each supported by a stiffening plate 40 arranged perpendicular to it and to the support plate 26. An opening in the form of a slot 42 is formed in each connecting plate 38 into which slot the associated threaded rod 33 is received. This treaded shaft 33 carries two nuts 44, between which the connecting plate 38 is captured. By means of these nuts, the associated connecting plate and the bottom or support plate 26 connected with it can be rigidly clamped to the anchor 28. Since the ramp 16 in turn can be rigidly connected with the bottom plate 26, in a non-illustrated way, a secure connection between the earth anchors and the ramp is provided.

Figure 2:
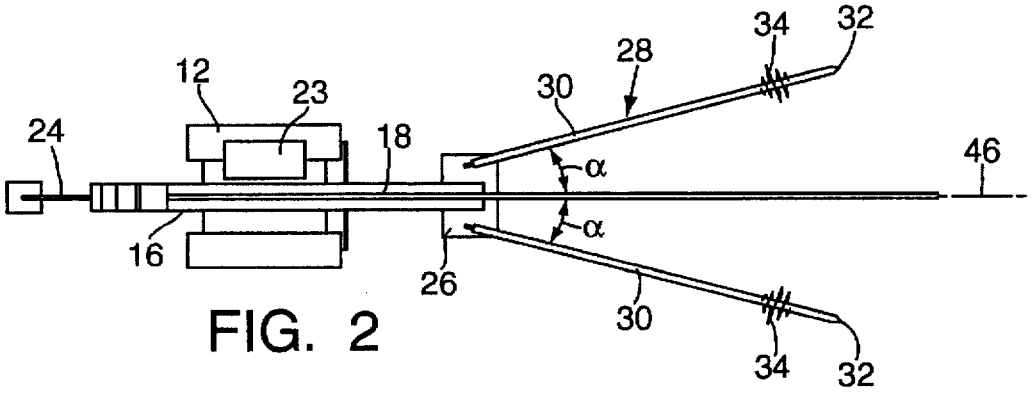
FIG. 2 A schematic plan view of the boring wagon with two earth anchors.
Figure 3:
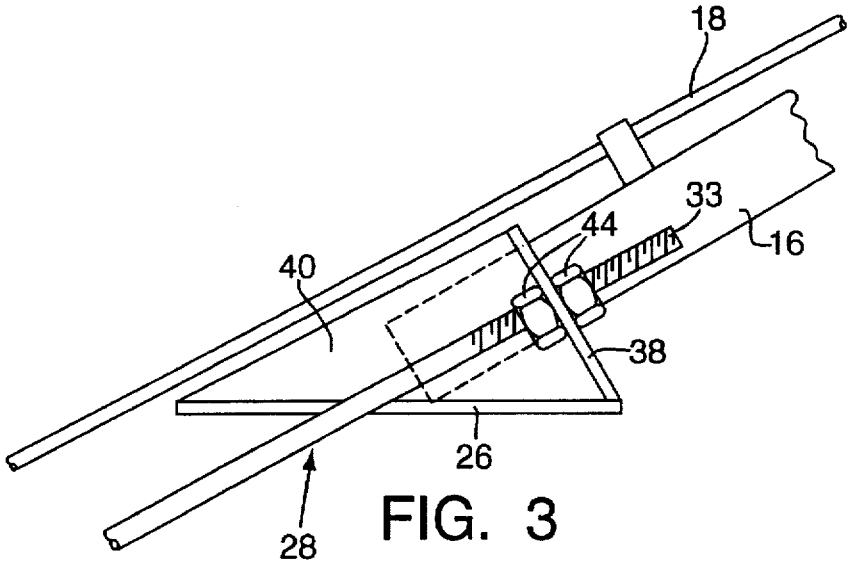
FIG. 3 A schematic side view of the connecting apparatus between the ramp of the boring wagon and the earth anchors, FIG. 4 A schematic plan view of the arrangement according to FIG. 3, and FIG. 5 A schematic illustration of the coupling connection between a threaded rod or extension rod and the rearward end of the shaft of an anchor.
Figure 4:
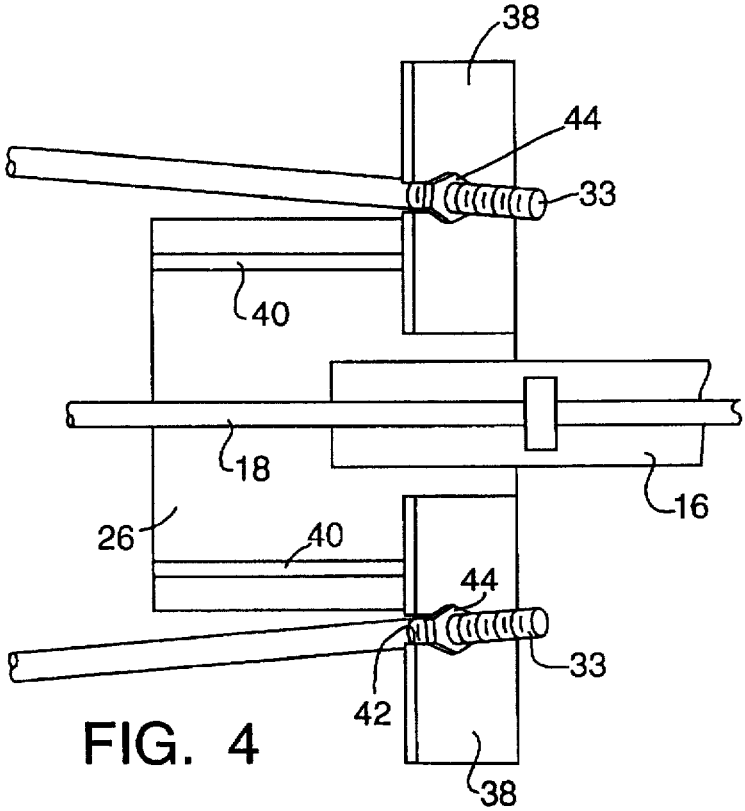

As can be seen in FIGS. 1 and 3, the earth anchors lie in a plane E parallel to the inclined plane of the ramp 20 with each of them nevertheless, according to the illustration in FIG. 2, forming a forwardly opening acute angle ($\alpha$) with the bore axis 46.

Before the boring is started, the ramp 16 is pivoted on the undercarriage 12 to the desired angle at which the boring rod is to be driven into the earth. Next the support plate 26 is laid onto the earth and the shaft 30 of an anchor is laid into the slot 42 of the connecting plate 38. The shaft 36 of the anchor is coupled with the drive unit on the ramp 16 for the boring rod and by rotation of this drive unit the anchor is axially driven into the ground. The emplacement of the second anchor takes place in the same way. If an anchor 28 has to be bored more deeply into the ground, the process is advanced using an extension rod coupled with the anchor. Subsequently, the anchors are secured by the nuts 44 to the associated connecting plate 38. The ramp is connected with the support plate 26.

When the boring procedure is now started, during the advancement of the boring rod, the 30 of the anchors are loaded in tension. Reversely, upon withdrawal of the boring rod and the simultaneous drawing into the bore of a widening head or a tube or cable to be laid the shafts 30 of the anchors are loaded in compression. In the case of both procedures, the shafts 30 of the anchors are subjected not at all or only insignificantly to transverse forces. Therefore, the boring wagon 10 in both process is stably anchored in its position making it possible to transfer the optimal force from the boring wagon 10 to the boring rod 18.

We claim:

1. An anchoring apparatus for use with a mobile earth boring mechanism supported on and movable over the earth's surface and operable to create bores in the earth extending generally parallel to the earth's surface, which mechanism includes a boring wagon having an undercarriage, a ramp with a forward end arranged on the undercarriage for holding and guiding a boring rod extending along the length of the ramp, the ramp being movable relative to the undercarriage to and from a working position at which working a position said ramp is located in a plane inclined to the earth's surface and at which said forward end of said ramp is supported on the earth's surface, and a drive unit for rotating and axially moving the boring rod along the length of the ramp, said anchoring apparatus comprising at least one anchor having an elongated shaft, and a connecting device for connecting the anchor to the boring wagon with the anchor so positioned that the elongated shaft of the anchor is arranged nearly parallel to said inclined plane in which the ramp is located when the ramp is in said working position.

2. An anchoring apparatus according to claim 1 wherein the anchor shaft as arranged nearly parallel to said inclined plane has a forward end located remote from said ramp and a rear end located closer to said ramp then said shaft forward end, said shaft near said shaft forward end carrying a helical worm extending through at least 3600°.

3. An anchoring device according to claim 2, wherein the shaft at said rear end has a coupling device for connection with an extension member and/or with a rotating and pushing drive.

4. An anchoring device according to claim 2, wherein the shaft is couplable with a rotary drive arranged on the boring wagon.

5. An anchoring apparatus according to claim 4, wherein the shaft is couplable with the drive for the boring rod.

6. An anchoring apparatus according to claim 2, wherein the diameter of the helical worm which extends for more than 360° proceeding from the middle of the helical worm diminishes in going toward both the forward and rear ends of the shaft.

7. An anchoring apparatus according to claim 2, wherein a centering point is provided on the end of the shaft which is drivable into the earth.

8. An anchoring apparatus according to claim 2, wherein the connecting device has a support plate intended for bearing engagement with the earth's surface which support plate on one hand is connectable with the forward end of the inclined ramp and on another hand carries means for connecting the support plate with the anchor.

9. An anchoring apparatus according to claim 8, wherein the connecting means includes a connecting plate connected rigidly to the support plate and essentially perpendicular to said inclined plane of the ramp and which connecting plate has an opening through which the shaft of the anchor can be fed with play, and in that the shaft of the anchor or of a rod coaxially couplable to said shaft carries an external thread for threadably receiving clamping nuts between which nuts the connecting plate is clampable.

10. An anchoring apparatus according to claim 8, wherein the shaft of the anchor on at least a portion of its length is provided with an external thread which is threadably receivable by a threaded sleeve connected to the support plate.

11. An anchoring apparatus according to claim 1, wherein two anchors are arranged respectfully on both sides of the boring rod.

12. An anchoring apparatus according to claim 11, wherein the two anchors each form a forwardly opening acute angle with the boring rod axis.

* * * * *